US006352067B1

(12) United States Patent
Genslak

(10) Patent No.: US 6,352,067 B1
(45) Date of Patent: Mar. 5, 2002

(54) RETURNLESS FUEL SYSTEM PRESSURE VALVE WITH TWO-WAY PARASITIC FLOW ORIFICE

(75) Inventor: Robert Genslak, Macomb Township, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/626,103

(22) Filed: Jul. 26, 2000

(51) Int. Cl.[7] ..... F02M 37/04
(52) U.S. Cl. ..... 123/510; 123/511; 123/514
(58) Field of Search ..... 123/510, 511, 123/457, 514, 467, 516; 137/493.8, 568; 251/117

(56) References Cited

U.S. PATENT DOCUMENTS

| | | | | |
|---|---|---|---|---|
| 4,709,680 A | | 12/1987 | Turchi | |
| 5,339,785 A | | 8/1994 | Wilksch | |
| 5,361,742 A | * | 11/1994 | Briggs et al. | 123/514 |
| 5,477,829 A | * | 12/1995 | Hassinger et al. | 123/467 |
| 5,623,910 A | * | 4/1997 | Riggle | 123/510 |
| 5,673,670 A | | 10/1997 | Powell et al. | |
| 5,797,374 A | | 8/1998 | Minagawa | |

FOREIGN PATENT DOCUMENTS

| | | |
|---|---|---|
| GB | 638537 | 6/1950 |

* cited by examiner

*Primary Examiner*—Thomas N. Moulis
(74) *Attorney, Agent, or Firm*—John E. Kajander

(57) ABSTRACT

A fuel system pressure valve includes is interposed in a fuel line between a fuel pump and a fuel rail for controlling fuel flow from the pump to the rail and from the rail to the pump. The valve includes a valve housing having a pair of half sections to form a valve chamber. A check valve is mounted in the chamber and is operable to allow fuel flow from the pump to the fuel line upon the fuel pump delivering a predetermined fuel pressure to the fuel line. A pressure relief valve is mounted within the chamber parallel to the check valve and is operable to allow fuel in the fuel line to flow through the housing to the fuel pump upon fuel pressure in the fuel line exceeding a predetermined relief pressure. In addition, a parasitic flow orifice is mounted in fluid communication with the valve chamber and allows fuel in the valve chamber to flow through the orifice to a fuel tank when valve chamber pressure is below a predetermined valve chamber pressure. Fuel is prevented from flowing through the parasitic flow orifice when the valve chamber pressure exceeds the predetermined valve chamber pressure.

14 Claims, 1 Drawing Sheet

RETURNLESS FUEL SYSTEM PRESSURE VALVE WITH TWO-WAY PARASITIC FLOW ORIFICE

TECHNICAL FIELD

The present invention relates generally to automotive fuel systems, and more particularly, to a returnless fuel system pressure valve with two-way parasitic flow orifice.

BACKGROUND ART

Conventional fuel injection systems utilize a fuel pump to provide fuel to a fuel rail that carries fuel to a plurality of fuel injectors. A pressure regulator is mounted in the fuel flow path so as to maintain the fuel pressure in the rail at approximately 40-psi greater than engine intake manifold vacuum. The pump, typically mounted in the fuel tank, runs at a constant speed and may deliver, for example, 90 liters per hour.

An Electronic Returnless Fuel System (ERFS) uses pulse width modulation (PWM) to control the voltage to the fuel pump in order to properly maintain a predetermined pressure differential across the fuel injectors. While PWM allows for improved fuel pump durability there can be an issue during low fuel flow requirements where limited voltage is supplied to the fuel pump. During a hot idle condition vapor lock may occur which prevents the fuel pump from delivering fuel to the engine. This vapor lock occurs because the low voltage being supplied to the fuel pump at an idle condition is not sufficient to drive the turbine at a high enough RPM to remove any vapor from the pumping chamber of the fuel pump.

Currently, ERFS applications use a Fuel Delivery Module (FDM) as their fuel pump sender assembly. The FDM includes a fuel storage container, as well as the fuel pump. A jet pump attached to the FDM takes a portion of the flow from the pump and uses that flow to keep the module filled. This allows the fuel pump to be surrounded by fuel at all times, thus improving low fuel-handling performance. An additional benefit of the jet pump is that it requires the fuel pump to output more flow to maintain both the flow requirements of the engine as well as the requirement of maintaining fuel within the module. The FDM typically includes a Parallel Pressure Relief Valve (PPRV). This valve contains a check valve and a relief valve in parallel with the check valve.

Certain ERFS applications use a pump and bracket assembly instead of an FDM. The pump and bracket assembly does not contain the PPRV or a jet pump. Fuel out of the pump is delivered directly to the engine. The lack of a jet pump has led to a change to the PPRV for the pump and bracket ERFS applications to prevent possible vapor lock conditions. The change involves an addition of a fixed orifice bleed port on the check valve side of the PPRV. This orifice, depending on the size, bleeds off a certain amount of fuel similar to the jet pump on the FDM.

Typical flows out of the orifice, to help prevent vapor lock at hot idle conditions, have been around 15–20 LPH. With the fixed orifice, this amount of flow will bleed back into the fuel tank not only at idle (where it is needed) but at wide-open throttle (WOT) as well. Unfortunately, this additional flow must be accounted for when sizing a fuel pump for an ERFS application and results in using a larger and more costly pump than required during non-idle conditions.

The disadvantages associated with these conventional returnless fuel delivery techniques have made it apparent that a new technique for returnless fuel delivery is needed. The new technique should prevent vapor lock and should not require fuel pump oversizing for non-idle conditions. The present invention is directed to these ends.

SUMMARY OF THE INVENTION

It is, therefore, an object of the invention to provide an improved and reliable returnless fuel system pressure valve with two-way parasitic flow orifice. Another object of the invention is to prevent vapor lock conditions while not requiring fuel pump oversizing for non-idle conditions.

In accordance with the objects of this invention, a returnless fuel system pressure valve with two-way parasitic flow orifice is provided. In one embodiment of the invention, a fuel system pressure valve is interposed in a fuel line between a fuel pump and a fuel rail for controlling fuel flow from the pump to the rail and from the rail to the pump. The valve includes a valve housing having a pair of half sections to form a valve chamber. A check valve is mounted in the chamber and is operable to allow fuel flow from the pump to the fuel line upon the fuel pump delivering a predetermined fuel pressure to the fuel line. A pressure relief valve is mounted within the chamber parallel to the check valve and is operable to allow fuel in the fuel line to flow through the housing to the fuel pump upon fuel pressure in the fuel line exceeding a predetermined relief pressure. In addition, a parasitic flow orifice is mounted in fluid communication with the valve chamber and allows fuel in the valve chamber to flow through the orifice to a fuel tank when valve chamber pressure is below a predetermined valve chamber pressure. Fuel is prevented from flowing through the parasitic flow orifice when the valve chamber pressure exceeds the predetermined valve chamber pressure.

The present invention thus achieves an improved returnless fuel system pressure valve with two-way parasitic flow orifice. The present invention is advantageous in that it prevents vapor lock during idle conditions by allowing parasitic fuel flow, but does not require an oversized fuel pump because parasitic fuel flow is prevented for non-idle conditions.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
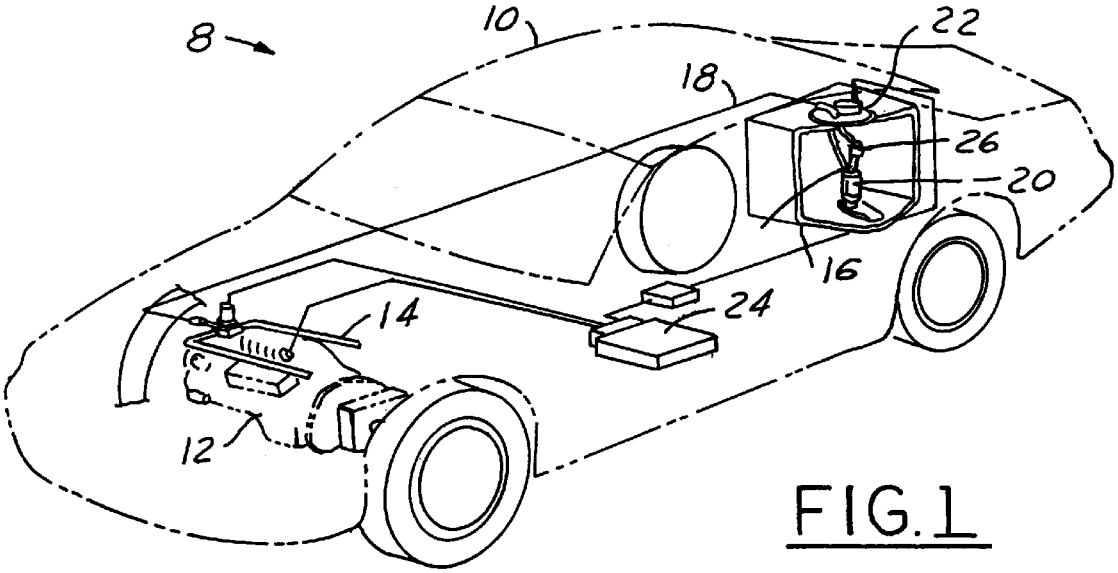
FIG. 1 is a perspective view of an automotive fuel delivery system employing a pressure valve in accordance with one embodiment of the present invention.

In the following figures, the same reference numerals will be used to identify identical components in the various views. The present invention is illustrated with respect to a valve having a two-way parasitic flow orifice, particularly suited for the automotive field. However, the present invention is applicable to various other fields and uses that may require a pressure valve with a two-way parasitic flow orifice.

Referring now to the drawings, in FIG. 1 a perspective view of an automotive fuel delivery system 8 employing a pressure valve in accordance with one embodiment of the present invention is illustrated. An automotive vehicle 10 includes an internal combustion engine 12 conventionally mounted in a forward section thereof. Those skilled in the art will appreciate that FIG. 1 is a schematic drawing of a fuel delivery system 8 according to the present invention for illustrative purposes only, and is not meant to represent actual vehicle 10 component locations or dimensions. Fuel rail 14 is mounted atop engine 12 for delivery of fuel thereto in a manner known to those skilled in the art. Fuel is delivered to fuel rail 14 from fuel tank 16 through fuel line 18 by the pumping action of fuel pump 20, preferably an electric pump, which is mounted in fuel tank 16 via flange 22 in a well known fashion. Proper mass flow rate to fuel rail 14 is controlled by an electronic engine control (EEC) unit, generally designated 24, which varies fuel pump 20 voltage, and thus speed, in response to several engine operating parameters, including fuel temperature, fuel pressure, engine RPM, and fuel injector pulse width.

Although EEC 24 can effectively control fuel mass flow rate to engine 12 under most engine operating conditions by varying fuel pump speed, there are certain circumstances, such as when fuel rail pressure becomes excessive, when turning off fuel pump 20 will not prevent excessive fuel injection. Such situations might occur, for example, during long deceleration periods when residual engine heat raises the temperature of fuel within fuel rail 14. In addition, pressure within fuel rail 14 may rise after engine 12 shut-off, particularly in high ambient temperature conditions. The present invention provides pressure valve 26 interposed in fuel line 18 between fuel pump 20 and fuel rail 14 for controlling fuel flow from pump 20 to fuel rail 14 and vice versa. Preferably, pressure valve 26 is mounted within fuel tank 16 near output side 20*a* of fuel pump 20, as seen in FIG. 1.

Figure 2:
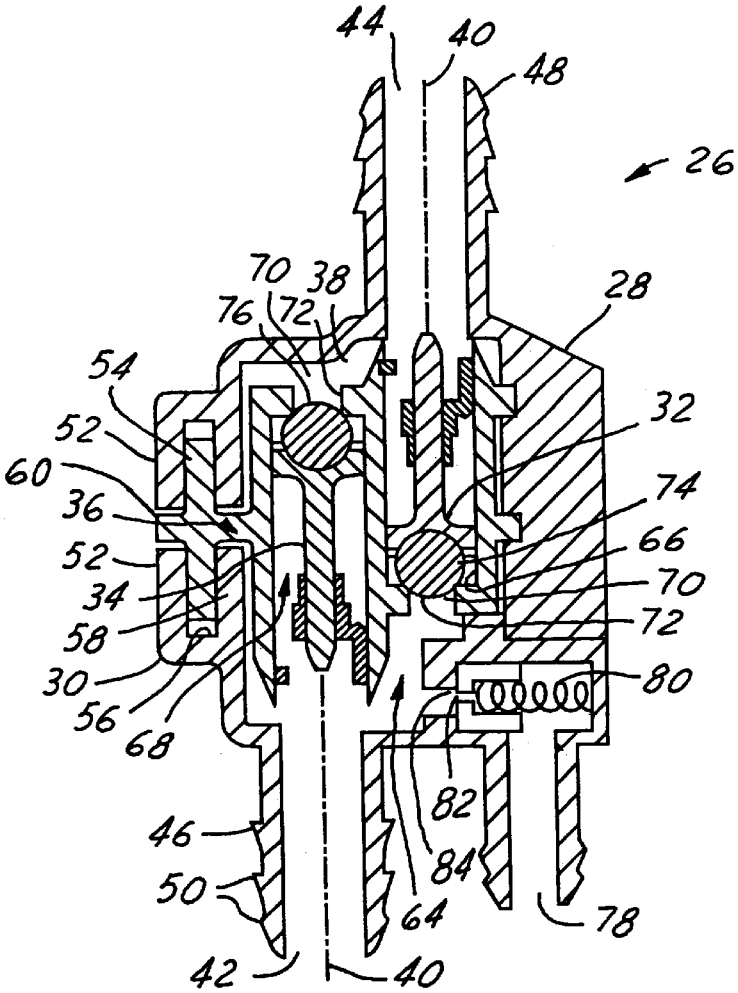
FIG. 2 is a cross sectional view of a returnless fuel system pressure valve with two-way parasitic flow orifice in accordance with one embodiment of the present invention.

Referring now to FIG. 2, a cross sectional view of a returnless fuel system pressure valve with two-way parasitic flow orifice in accordance with one embodiment of the present invention is illustrated. Pressure valve 26 has a pair of generally oblong-shaped half sections 28 which form a housing 30 for containing pump check valve 32 and pressure relief valve 34. Center section 36 serves as a guide for combining half sections 28 as well as a fixture for mounting check valve 32 and pressure relief valve 34 in parallel with respect to axis 40 through inlet 42 and outlet 44, within chamber 38 of housing 30. Check valve 32 and relief valve 34 are situated in parallel so that fuel flow from pump 20 to rail 14 can be controlled, and, more importantly, that fuel flow from rail 14 to pump 20 can be controlled to relieve fuel line 18 pressure under certain engine cycles.

Each half section 28 has a nipple, or tubular connector 46, which extends from housing 30 for connection with a fluid bearing device, such as fuel line 18 or fuel pump output side 20*a*. Preferably, connector 46 has annular fir-tree shaped barbs 50 which provide a firm fit between connector 46 and, for example, a portion of fuel line 18 within fuel tank 16.

The inner side of half-section 28 has a generally oblong outer shoulder 52 concentric with generally oblong inner shoulder 54. Oblong slot 56 is formed between outer shoulder 52 and inner shoulder 54 of half-section 28 for receiving connector shoulder 58 of center section 36. Outer shoulder 52 mates with ledge 60 of center section 28 when half-section 28 and center section 36 are combined (FIG. 5). Double-bore 64 comprises check valve bore 66 and relief valve bore 68 for receiving check valve 32 and relief valve 34, respectively. Each bore of double-bore 64 has a valve seat 70 adjacent to an orifice 72 for receiving a valve element, for example, mushroom shaped element 74 of check valve 32 and ball 76 of relief valve 34. Check valve bore 66 and relief valve bores 68 are oppositely oriented in the axial, or longitudinal, direction so as to control fuel flow in opposite directions, as further discussed below.

It will be apparent to those skilled in the art that half-sections 28 need not be limited to the shape described above, but can be any shape so long as check valve 32 and relief valve 34 are supported in generally parallel alignment to fuel flow through pressure valve 26. Indeed, housing 30 may be of a completely different construction, with differently shaped or asymmetrical half-sections 28, or without half-sections 28. The configuration described above, however, reduces manufacturing costs due to the symmetrical nature of half-sections 28, partially as a result of a decrease in tool design, while also providing a pressure valve 26 which is easily assembled.

Preferably, half-sections 28 are made of a thermoplastic material, such as acetyl, and ultrasonically welded together with center portion 36 therebetween. Check valve 32 and relief valve 34 are assembled within center portion 36 before half-sections 28 are welded together. Center section 36 is likewise made of a thermoplastic material, such as acetyl, so as to meld with half-sections 28 during the welding process. Alternatively, half-sections 28 and center section 36 can be made of different materials, such as fuel resistant plastics, nylon or PPS, and attached in other ways known to those skilled in the art, for example with adhesives or overmolding. Once combined, pressure valve 26 is connected to the fuel delivery system of vehicle 10 as shown in FIG. 1. Connection is accomplished by mounting pressure valve 26 to the output side 20*a* of fuel pump 20.

A parasitic flow orifice 78 is mounted in fluid communication with said valve chamber 38 and is operable to allow fuel in valve chamber 38 to flow through the parasitic flow orifice 78 to fuel tank 16. This flow only occurs when valve chamber 38 pressure is below a predetermined valve chamber pressure level. Parasitic flow is prevented when valve chamber 38 pressure exceeds the predetermined valve chamber pressure level. This is done through the use of a poppet type valve 84. A spring assembly 80 works against the flow of fuel pump 20 and allows fuel to pass through an orifice 82 located in poppet valve 84. This allows fuel to pass through the orifice 82 and through the bleed port 78. When the pressure differential across the orifice 82 becomes greater than the spring 80 tension the poppet valve 84 will begin moving across the opening of the bleed port 78 slowing cutting off fuel flow through the port 78. At such time that the pressure differential across the orifice 82 is great enough, the poppet valve 84 will have entirely blocked the flow through the bleed port 78. This allows all fuel out of the fuel pump 20 to flow through the check valve 32 and downstream to the engine 14.

In operation at engine start-up, fuel pump 20 pumps fuel from tank 16 to inlet 42 of pressure valve 26. Spring 80 in check valve 32 has a predetermined set point of approximately 1–3 psi, and preferably 2 psi, but in any event is set below the predetermined set point of relief valve 34, which is further discussed below. When fuel pressure from fuel pump 20 exceeds the check valve 32 set point, mushroom shaped element 74 is forced from seat 70 to allow fuel flow through orifice 72. Fuel is thus pumped by fuel pump 20 from tank 16, through pressure valve 26, and to fuel rail 14. During normal operation, pressure within fuel line 18 typically varies between 30 psi and 40 psi as engine demand varies and EEC 24 modifies fuel pump 20 speed to accommodate that demand. Relief valve 34 within pressure valve 26 remains closed during these operating conditions and pressures.

Under certain conditions, such as long deceleration periods on a declining stretch of road, EEC 24 may reduce pump 20 speed to a small amount, or even stop it altogether, since engine 12 demands little fuel. Fuel pressure in fuel line 18 will rise rapidly to an unacceptable level, however, due to the sudden decrease in fuel demand since EEC 24 cannot respond instantly to decrease fuel pump 20 output. When pressure within fuel line 18 rises above the set point of relief valve 34, typically between 30 psi and 45 psi depending on engine application, ball 76 is forced from seat 70 to allow fuel flow through orifice 72. Fuel is thus allowed to flow from fuel line 18, through pressure valve 26, and to output side 20*a* of fuel pump 20. The predetermined set point of relief valve 34 is set substantially above that of check valve 32.

From the foregoing, it can be seen that there has been brought to the art a new and improved returnless fuel system pressure valve with two-way parasitic flow orifice. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A returnless fuel system pressure valve comprising:

a valve housing having a pair of half sections, with each of said half sections having a valve receiving portion and a nipple for attachment to a fluid bearing device, said valve housing also having a valve center portion for attachment with said pair of half sections so that said pair of half sections cooperate to form a valve chamber;

a check valve mounted in said valve center portion within said chamber and operable to allow fuel flow from said pump to said fuel line upon said fuel pump delivering a predetermined fuel pressure to said fuel line;

a pressure relief valve mounted in said valve center portion within said valve chamber parallel to said check valve and operable to allow fuel in said fuel line to flow through said housing to said fuel pump upon fuel pressure in said fuel line exceeding a predetermined relief pressure greater than said predetermined fuel pressure; and a parasitic flow orifice mounted in fluid communication with said valve chamber and operable to allow fuel in said valve chamber to flow through said parasitic flow orifice to said fuel tank when valve chamber pressure is below a predetermined valve chamber pressure, said parasitic flow orifice preventing fuel in said valve chamber from flowing through said parasitic flow orifice when said valve chamber pressure exceeds said predetermined valve chamber pressure.

2. The returnless fuel system pressure valve with two-way parasitic flow orifice as recited in claim 1, wherein said parasitic flow orifice comprises a poppet valve.

3. The returnless fuel system pressure valve with two-way parasitic flow orifice as recited in claim 2, wherein said poppet valve includes a bleed orifice.

4. The returnless fuel system pressure valve with two-way parasitic flow orifice as recited in claim 3, wherein said poppet valve is coupled to a spring assembly whereby said spring assembly works against said valve chamber pressure.

5. The returnless fuel system pressure valve with two-way parasitic flow orifice as recited in claim 4, wherein said poppet valve is located and moves within a bleed port bore, said bleed port bore in fluid communication with said parasitic flow orifice.

6. The returnless fuel system pressure valve with two-way parasitic flow orifice as recited in claim 5, wherein said poppet valve is operable to prevent fuel flow through said bleed port bore by covering a bleed port passage.

7. The returnless fuel system pressure valve with two-way parasitic flow orifice as recited in claim 1, wherein said housing is plastic.

8. A fuel delivery system for an automotive internal combustion engine comprising:

a fuel tank;

a fuel pump in fluid communication with said fuel tank and a fuel line on an output side of said pump in fluid communication with a fuel rail connected to said engine; and a main valve interposed in said fuel line between said fuel pump and said fuel rail for controlling said fuel flow from said pump to said rail and from said rail to said pump, said main valve comprising:

a valve housing having a pair of half sections, with each of said half sections having a valve receiving portion and a nipple for attachment to a fluid bearing device, said valve housing also having a valve center portion for attachment with said pair of half sections so that said pair of half sections cooperate to form a valve chamber;

a check valve mounted in said valve center portion within said chamber and operable to allow fuel flow from said pump to said fuel line upon said fuel pump delivering a predetermined fuel pressure to said fuel line;

a pressure relief valve mounted in said valve center portion within said valve chamber parallel to said check valve and operable to allow fuel in said fuel line to flow through said housing to said fuel pump upon fuel pressure in said fuel line exceeding a predetermined relief pressure greater than said predetermined fuel pressure; and a parasitic flow orifice mounted in fluid communication with said valve chamber and operable to allow fuel in said valve chamber to flow through said parasitic flow orifice to said fuel tank when valve chamber pressure is below a predetermined valve chamber pressure, said parasitic flow orifice preventing fuel in said valve chamber from flowing through said parasitic flow orifice when said valve chamber pressure exceeds said predetermined valve chamber pressure.

9. The fuel delivery system for an automotive internal combustion engine as recited in claim 8, wherein said parasitic flow orifice comprises a poppet valve.

10. The fuel delivery system for an automotive internal combustion engine as recited in claim 9, wherein said poppet valve includes a bleed orifice.

11. The fuel delivery system for an automotive internal combustion engine as recited in claim 10, wherein said poppet valve is coupled to a spring assembly whereby said spring assembly works against said valve chamber pressure.

12. The fuel delivery system for an automotive internal combustion engine as recited in claim 11, wherein said poppet valve is located and moves within a bleed port bore, said bleed port bore in fluid communication with said parasitic flow orifice.

13. The fuel delivery system for an automotive internal combustion engine as recited in claim 12, wherein said poppet valve is operable to prevent fuel flow through said bleed port bore by covering a bleed port passage.

14. The fuel delivery system for an automotive internal combustion engine as recited in claim 8, wherein said housing is plastic.

* * * * *